United States Patent [19]

Allen, Jr.

[11] 4,413,951

[45] Nov. 8, 1983

[54] CAPACITY CONTROL ARRANGEMENT FOR FIXED SPEED COMPRESSOR

[75] Inventor: Clifford W. Allen, Jr., Lexington, Ky.

[73] Assignee: Lexair, Inc., Lexington, Ky.

[21] Appl. No.: 194,021

[22] Filed: Oct. 6, 1980

[51] Int. Cl.[3] ..... F04B 49/02

[52] U.S. Cl. ..... 417/53; 417/252; 417/309

[58] Field of Search ..... 417/252, 301, 309, 254, 417/442, 295, 456, 458, 54, 55, 53

[56] References Cited

U.S. PATENT DOCUMENTS

| | | | |
|---|---|---|---|
| 1,760,070 | 5/1930 | Kinsella | 417/252 |
| 2,715,992 | 8/1955 | Wilson | 417/309 |
| 3,415,441 | 12/1968 | Kehler | 417/458 |
| 3,626,979 | 12/1971 | Abell | 417/252 X |

*Primary Examiner*—Richard E. Gluck
*Assistant Examiner*—Peter M. Cuomo
*Attorney, Agent, or Firm*—Frank C. Leach, Jr.

[57] ABSTRACT

A two-stage reciprocating compressor has its low pressure stage inlet connected to a source of gas generating a varying volume of gas. When the supply of gas generated is reduced to an extent that the pressure at the low pressure stage inlet decreases below a predetermined pressure, the compressor is unloaded at either the discharge outlet of its low pressure stage or the discharge output of its high pressure stage through opening a valve in a line connecting the discharge outlet of the low pressure or high pressure stage with the inlet of the low pressure stage.

24 Claims, 6 Drawing Figures

CAPACITY CONTROL ARRANGEMENT FOR FIXED SPEED COMPRESSOR

This invention relates to a compressor operating at a fixed speed and, more particularly, to a capacity control arrangement for a compressor operating at a fixed speed and having its inlet connected to a gas generator generating a varying volume of gas.

Various arrangements for unloading a compressor to control its capacity are disclosed in U.S. Pat. Nos. 1,404,175 to Holdsworth et al, 3,527,548 to Kocher et al, 3,626,979 to Able, 3,924,972 to Szymaszek, and 4,080,110 to Szymaszek. These patents are concerned with various types of compressors in which there may be a varying unloading, for example.

In a reciprocating compressor operating at a fixed speed with a fixed distance pressure, the capacity of the compressor varies in accordance with its inlet pressure. That is, as the inlet pressure increases, the capacity of the compressor increases.

When the inlet of a fixed speed reciprocating compressor is connected to a gas generator generating a varying supply or flow rate of gas, a reduction in the flow rate of the gas from the gas generator causes the inlet pressure of the compressor to decrease. If the inlet pressure drops below a predetermined pressure, it is necessary to be able to supply gas from some other source to the inlet of the compressor to prevent possible damage to the compressor if the compressor is allowed to continue to operate.

Therefore, when the inlet of a reciprocating compressor operating at a fixed speed is connected to receive gas generated from a controlled environment or ambient, it is desired to use only the gas from such an environment or ambient in the compressor and not to have to employ gas from another area. For example, if the inlet of the compressor is connected to a stripper for removing carbon dioxide gases from the air in a submarine, for example, this varying supply of carbon dioxide gas generated from the stripper, depending upon the activity of the personnel in the submarine, can significantly vary the amount of gas supplied to the inlet of the compressor. As a result, it has previously been necessary to also connect the inlet of the compressor to an area of the submarine to withdraw ambient air therefrom when there was not sufficient carbon dioxide gas being supplied to the inlet of the compressor from the carbon dioxide stripper.

This arrangement has required a valve to be manually operated when the pressure at the inlet of the compressor has dropped below a predetermined pressure. Thus, this has been dependent upon at least one person continuously monitoring an inlet pressure gauge of the compressor and opening and closing the valve controlling the flow of air from the area of the submarine to the inlet of the compressor in accordance with the quantity of carbon dioxide gas supplied to the compressor from the carbon dioxide stripper.

While this removal of air, rather than just carbon dioxide gas, from the area of the submarine is not significant, it decreases the ambient air in the submarine to a degree greater than when using the carbon dioxide gas from the stripper so that eventually it becomes necessary to add oxygen to the area. It also has the disadvantage of requiring at least one person to continuously monitor the inlet pressure of the compressor and to operate the valve.

The present invention overcomes the foregoing problems through providing a capacity control arrangement for a compressor in which there is no requirement for any withdrawal of ambient air from the submarine directly to the inlet of the compressor. Instead, only the carbon dioxide gas from the carbon dioxide stripper is used when employing the capacity control arrangement of the present invention with a compressor, which is preferably a reciprocating compressor, operating at a fixed speed.

The present invention accomplishes this through connecting the discharge outlet of the low pressure stage or the high pressure stage, if the compressor is a two-stage reciprocating compressor as it is in its preferred embodiment, to the inlet of the compressor. The discharge outlet of the low pressure stage or the high pressure stage also is connected to the outlet of the carbon dioxide stripper, which generates the varying supply of gas.

By returning the pressurized gas from the discharge side of the compressor to the stripper, the pressure of the stripper also can be maintained at a higher pressure than when the compressor received ambient air from the area of the submarine when the flow rate of carbon dioxide gas from the carbon dioxide stripper decreased. This increased pressure in the stripper enables the stripper to operate more efficiently than in the prior structure in which the pressure in the stripper was not increased.

The connection between the discharge outlet of the compressor and the inlet of the compressor is preferably controlled by valve means. The valve means is responsive to the pressure at the inlet of the compressor and opens when the inlet pressure falls below a predetermined pressure.

An object of this invention is to automatically control the capacity of a compressor operating at a fixed speed.

Another object of this invention is to enable a fixed speed compressor to have gas from a source of a varying supply capacity as its sole supply source.

Other objects of this invention will be readily perceived from the following description, claims, and drawings.

This invention relates to the combination of a compressor operating at a fixed speed and gas generating means producing a varying supply of gas. The compressor has its inlet communicating with the gas generating means to receive gas therefrom with the compressor including means to compress the gas entering the inlet of the compressor, which has an outlet to discharge the compressed gas. Communication between the outlet of the compressor and the inlet of the compressor is provided by first connecting means exterior of the compressor with the first connecting means providing the sole communication between the outlet of the compressor and the inlet of the compressor. Valve means in the first connecting means blocks the first connecting means when the gas generating means is supplying sufficient gas to maintain the pressure of the gas at the inlet of the compressor above a predetermined pressure. The first connecting means has causing means therein to cause movement of the valve means to a position in which the valve means does not block the first connecting means when the pressure at the inlet of the compressor drops below the predetermined pressure.

This invention also relates to a method of controlling a compressor operating at a fixed speed and having its inlet communicating with carbon dioxide generating means producing a varying supply of carbon dioxide from an ambient with which the carbon dioxide generating means communicates. The method includes connecting an outlet of the compressor with its inlet exterior of the compressor to provide the sole communication between the outlet of the compressor and the inlet of the compressor and blocking the connection of the outlet of the compressor with its inlet when the carbon dioxide generating means is supplying sufficient carbon dioxide to maintain the pressure of the carbon dioxide at the inlet of the compressor above a predetermined pressure so that the compressed carbon dioxide is discharged exterior of the ambient with which the carbon dioxide generating means communicates. The connection of the outlet of the compressor with its inlet is unblocked when the carbon dioxide generating means is not supplying sufficient gas to maintain the pressure of the carbon dioxide at the inlet of the compressor above the predetermined pressure.

The attached drawings illustrate preferred embodiments of the invention, in which.

Figure 1:
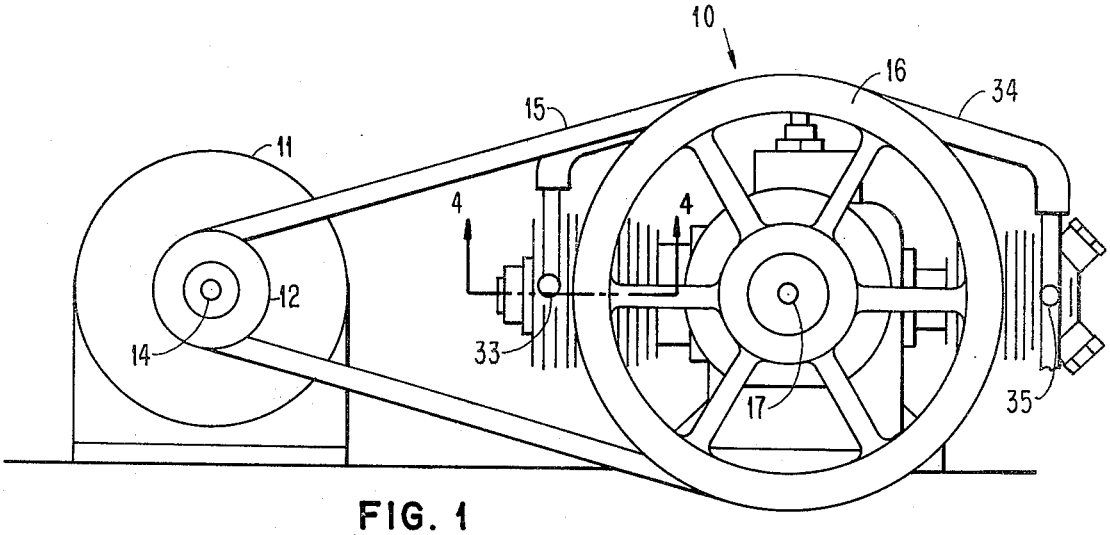
FIG. 1 is a schematic front elevational view of a two-stage reciprocating compressor and its driving means with the compressor having the control arrangement of the present invention.

Referring to the drawings and particularly FIG. 1, there is shown a two-stage reciprocating compressor 10 driven at a fixed speed from an electric motor 11. The motor 11 has a pulley 12 mounted on its shaft 14. A belt 15 passes around the pulley 12 and a sheave 16, which functions as a flywheel, of the compressor 10. The sheave 16 is fixed to a crankshaft 17 to enable driving of the crankshaft 17 at a fixed speed by the motor 11.

Figure 3:
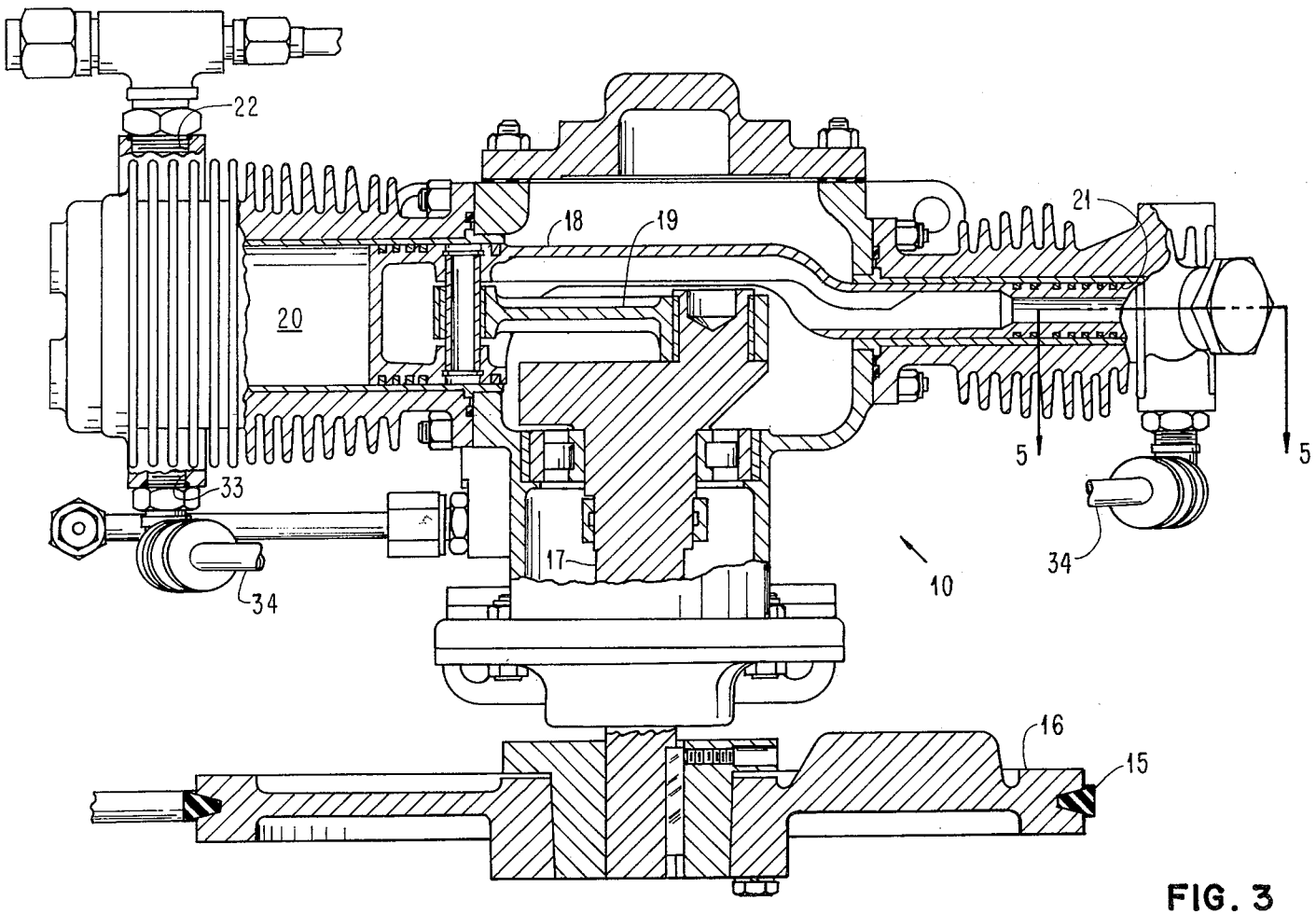
FIG. 3 is a sectional view, partly in top plan, of the compressor of FIG. 1.

A piston 18 (see FIG. 3) is connected to the crankshaft 17 through a connecting rod 19. One end of the piston 18 reciprocates within a low pressure stage cylinder 20 and the other end of the piston 18 reciprocates within a high pressure stage cylinder 21, which is disposed opposite the low pressure stage cylinder 20. As shown in FIG. 3, the piston 18 is positioned at top dead center in the high pressure cylinder 21 while the piston 18 is disposed at bottom dead center in the low pressure stage cylinder 20.

Figure 4:
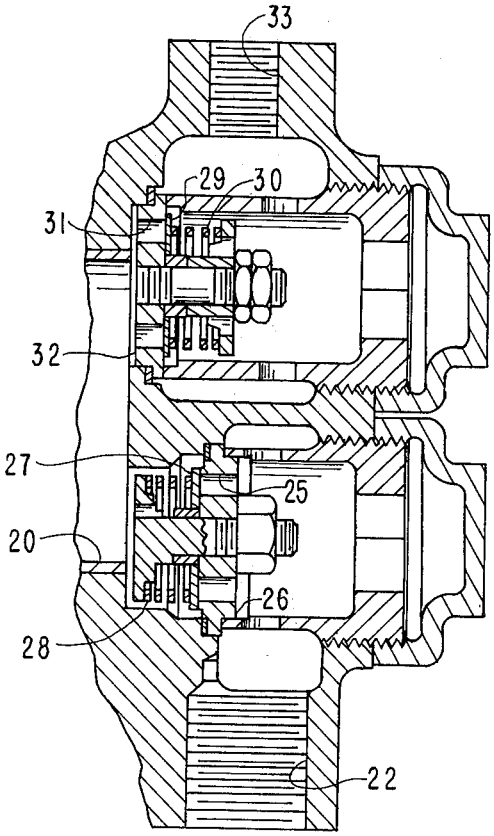
FIG. 4 is a fragmentary sectional view showing the intake and discharge valves of the low pressure stage of the compressor of FIG. 3 and taken along line 4—4 of FIG. 1.

The low pressure stage cylinder 20 has its inlet 22 (see FIGS. 2 and 4) communicating with a carbon dioxide stripper 23 (see FIG. 2), which is a source of a gas of varying supply capacity to the inlet 22 of the compressor 10. One suitable example of the carbon dioxide stripper 23 is a carbon dioxide stripper of a model Mark III B carbon dioxide scrubber of the U.S. Navy. These are manufactured by Cepeda Associates, Louisville, Ky. and Vitok Engineers, Louisville, Ky. The carbon dioxide stripper 23 removes the carbon dioxide from the air, which is then returned to the controlled environment or ambient such as the submarine living quarters, for example. Thus, because the carbon dioxide expelled by the breathing of each individual depends upon the activity of the individual, the amount of carbon dioxide generated by the stripper 23 at any time can vary significantly.

The outlet of the stripper 23 communicates with the inlet 22 through a conduit 23'. The conduit 23' has a back pressure valve 24, which is preferably a spring biased check valve, therein. Any other valve responsive to fluid pressure may be employed.

When the carbon dioxide gas from the stripper 23 enters the inlet 22 of the low pressure stage cylinder 20 (see FIG. 4), it flows into the low pressure stage cylinder 20 through a plurality of equally angularly spaced passages 25 in a valve seat 26 when an inlet valve 27 is moved to an open position against the force of a spring 28, which continuously urges the valve 27 to a closed position, by the suction within the low pressure stage cylinder 20. This occurs when the piston 18 moves away from the inlet valve 27 (This is to the right in FIG. 3).

When the piston 18 moves to the left in FIG. 3, the gas is compressed and a discharge valve 29 (see FIG. 4), which is continuously biased to its closed position by a spring 30, is moved to an open position to allow the compressed gas from the low pressure stage cylinder 20 to discharge through a plurality of equally angularly spaced passages 31 in a valve seat 32 for the valve 29. The compressed gas flows through a discharge outlet 33 to one end of an intercooler 34 (see FIGS. 1 and 3).

Figure 5:
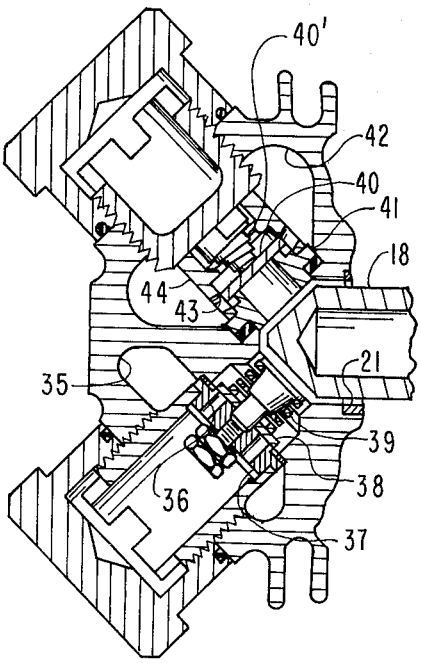
FIG. 5 is a fragmentary sectional view showing the intake and discharge valves of the high pressure stage of the compressor of FIG. 3 and taken along line 5—5 of FIG. 3.

The intercooler 34 has its other end communicating with an inlet 35 (see FIGS. 2 and 5) of the high perssure stage cylinder 21. When the piston 18 is moved to the left in FIG. 3, the gas flows from the inlet 35 (see FIGS. 2 and 5) through a plurality of equally angularly spaced passages 36 (see FIG. 5) in a valve seat 37 because an inlet valve 38 is moved away from engagement with the seat 37 by the suction created in the high pressure stage cylinder 21. The valve 38 is continuously urged to its closed position by a spring 39.

When the piston 18 is moved to the right in FIG. 3 by rotation of the crankshaft 17, a high pressure discharge valve 40 (see FIG. 5) which is continuously biased to its closed position by a spring 40', is moved away from its seat 41 to allow the compressed gas to escape from the high pressure stage cylinder 21 to a discharge outlet 42 through a plurality of equally angularly spaced passages 43 in a wall of a valve cage 44.

Figure 2:
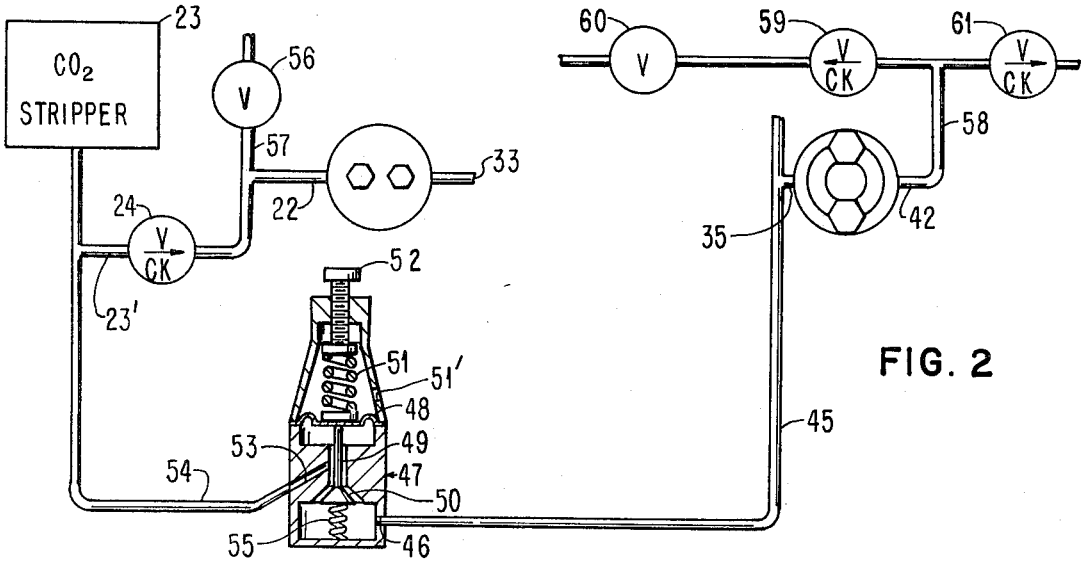
FIG. 2 is a schematic view of opposite ends of the compressor of FIG. 1 and showing the control arrangement of the present invention utilized therewith.

As shown in FIG. 2, the intercooler 34 (see FIG. 1) has its end, which communicates with the inlet 35 (see FIG. 2), also communicating with one end of a conduit 45. The conduit 45 has its other end connected to an inlet 46 in a valve housing 47. The valve housing 47 has a diaphragm 48 mounted therein and to which a stem 49 of a valve 50 secured for movement with the diaphragm 48.

A compression spring 51 acts on the upper surface of the diaphragm 48, which has its upper surface exposed to the ambient through a vent 51', to exert a downward force on the valve 50 to urge it to its open position. The force of the spring 51 is adjustable by an adjusting nut 52.

The diaphragm 48 has its lower surface communicating with an outlet 53 of the valve housing 47. A conduit 54 connects the outlet 53 with the outlet of the stripper 23. Thus, the pressure of the gas at the outlet of the stripper 23 is always applied to the diaphragm 48 because of the location of the valve 50 in the valve housing 47. When this gas pressure at the outlet of the stripper 23 decreases below a predetermined pressure as determined by the force of the compression spring 51, the valve 50 is moved to its open position to allow the compressed gas flowing from the discharge outlet 33 of the low pressure stage cylinder 20 (see FIG. 3) through the intercooler 34 to flow through the conduit 45 (see FIG. 2), the valve housing 47, and the conduit 54 to the stripper 23.

When the valve 50 is open, there is very little compression of the gas in the low pressure stage cylinder 20 (see FIG. 3). This is because the discharge valve 29 (see FIG. 4) opens early due to the lack of pressure on its downstream side because of the valve 50 (see FIG. 2) being open.

The predetermined pressure at which the valve 50 opens is selected as the pressure below which the stripper 23 does not operate efficiently. For example, the predetermined pressure at which the valve 50 moves to its open position would be when the pressure at the outlet of the stripper 23 decreases below 30 p.s.i.

This also would be the pressure differential at which the back pressure valve 24 opens. That is, the back pressure valve 24 also will not allow flow to the inlet 22 of the low pressure stage cylinder 20 (see FIG. 3) of the compressor 10 when the pressure differential across the back pressure valve 24 (see FIG. 2) falls below 30 p.s.i. However, the failure of gas to flow through the back pressure valve 24 results in a suction existing at the inlet 22 of the low pressure stage cylinder 20 (see FIG. 3) so that it does not require 30 p.s.i. at the outlet of the stripper 23 (see FIG. 2) for the back pressure valve 24 to open after there is no longer flow through the back pressure valve 24.

Furthermore, by the valve 50 being opened, it takes only a relatively short period of time such as five minutes to thirty minutes, for example, for the back pressure valve 24 to be moved to its open position and for the valve 50 to be moved to its closed position. When the valve 50 is moved to its closed position, a spring 55 aids the gas pressure from the outlet of the stripper 23 is overcoming the force of the spring 51 to move the valve 50 to its closed position.

Considering the operation of the present invention, the start up of the compressor 10 is preferably accomplished through opening a valve 56 in a conduit 57 to enable air from an area of the submarine, for example, to be supplied to the inlet 22 of the low pressure stage cylinder 20 (see FIG. 3) of the compressor 10. The valve 56 (see FIG. 2) is closed as soon as there is start up of the compressor 10.

After the carbon dioxide gas from the stripper 23 is compressed in the low stage pressure cylinder 20 (see FIG. 3), it flows through the intercooler 34. If the stripper 23 (see FIG. 2) is supplying carbon dioxide gas at a rate at least equal to the capacity of the compressor 10, the valve 50 is closed. At this time, the compressed gas from the low pressure stage cylinder 20 (see FIG. 3) flows from the intercooler 34 into the high stage pressure cylinder 21 and exits therefrom through the discharge outlet 42 (see FIG. 2) to a conduit 58. The gas flows from the conduit 58 through a check valve 59 and a manually controlled valve 60 to the sea in which the submarine is located. The conduit 58 also has a safety valve 61, which is preferably a spring biased check valve.

It should be understood that the valve 60 is closed at start up when the valve 56 is opened so that air from the area of the submarine is not dumped overboard. At this time, a hose (not shown) connects the outlet 42 to the stripper 23. It should be understood that the hose is removed, the valve 56 is closed, and the valve 60 is opened as soon as the valve 50 is moved to its closed position because this indicates that the pressure of the carbon dioxide gas from the stripper 23 is sufficiently high to supply the necessary quantity of gas to the compressor 10.

Whenever the flow of carbon dioxide gas from the stripper 23 decreases, the pressure in the conduit 54 decreases because of the suction created from the gas flowing from the stripper 23 to the compressor 10. When the pressure in the conduit 54 decreases below the predetermined pressure, the valve 50 opens to allow the gas flowing through the intercooler 34 (see FIG. 1) to return to the stripper 23 (see FIG. 2) rather than flow to the inlet 35 of the high pressure stage cylinder 21 (see FIG. 3).

Thus, there is no necessity for monitoring of the flow of the carbon dioxide gas from the stripper 23 (see FIG. 2) after the compressor 10 is started. There is automatic by-passing of the high pressure stage cylinder 21 (see FIG. 3) of the compressor 10 whenever the pressure at the inlet 22 of the low pressure stage cylinder 20 decreases below the predetermined pressure.

Figure 6:
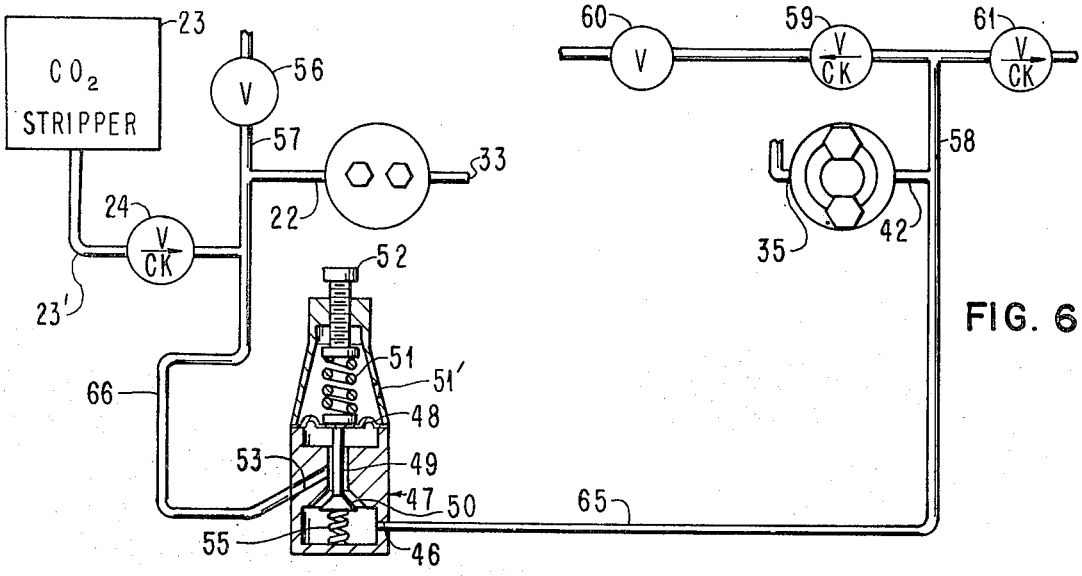
FIG. 6 is a schematic view, similar to FIG. 2, but showing another embodiment of the control arrangement of the present invention.

Referring to FIG. 6, there is shown another embodiment of the present invention in which the discharge outlet 42 of the high pressure stage cylinder 21 (see FIG. 3) of the compressor 10 is connected by a conduit 65 (see FIG. 6) to the inlet 46 of the valve housing 47. In this arrangement, the carbon dioxide gas is completely compressed in the low pressure stage cylinder 20 (see FIG. 3) and then supplied to the high pressure stage cylinder 21. There is very little compression of the gas in the high pressure stage cylinder 21 when the valve 50 (see FIG. 6) is open because of the low pressure at the discharge outlet 42 of the high pressure stage cylinder 21 (see FIG. 3).

The outlet 53 (see FIG. 6) of the valve housing 47 is connected by a conduit 66 to the inlet 22 of the low pressure stage cylinder 20 (see FIG. 3) of the compressor 10. Thus, the diaphragm 48 (see FIG. 6) of the valve housing 47 responds to the pressure at the inlet 22 of the low pressure stage cylinder 20 (see FIG. 3) rather than to the pressure at the outlet of the stripper 23 (see FIG. 6). However, because the stripper 23 eventually produces enough flow of carbon dioxide gas to create sufficient pressure to overcome the back pressure valve 24, the valve 50 moves to its closed position only when there is sufficient carbon dioxide gas being generated from the stripper 23 because this flow rate of gas will open the back pressure valve 24 and increase the pressure at the inlet 22 of the low pressure stage cylinder 20 (see FIG. 3) of the compressor 10.

The remainder of the operation of FIG. 6 is the same as that discussed with regard to the embodiment of FIGS. 1–5. It is only the connection of the inlet 46 and the outlet 53 of the valve housing 47 that are changed.

It should be understood that the embodiment of FIG. 6 could have the outlet 53 of the valve housing 47 connected to the stripper 23 in the same manner as described in FIG. 2. Likewise, in the arrangement of FIG. 2, the valve housing 47 could have the outlet 53 connected to the inlet 22 of the low pressure stage cylinder 20 (see FIG. 3) of the compressor 10 in the same manner as disclosed in FIG. 6.

Furthermore, if desired, the back pressure valve 24 may be omitted in either the embodiment of FIG. 2 or FIG. 6. Thus, the outlet 53 of the valve housing 47 would always communicate directly with both the inlet 22 of the low pressure stage cylinder 20 (see FIG. 3) of the compressor 10 and the outlet of the stripper 23 (see FIG. 2).

While the present invention has shown and described the compressor 10 as being a reciprocating compressor having two stages, it should be understood that the compressor 10 could have a single stage or a plurality of stages greater than two if desired. It also should be understood that the compressor 10 could be a vane or screw compressor if desired.

An advantage of this invention is that it substantially reduces the capacity of a compressor when the pressure of the supply gas falls below a predetermined pressure. Another advantage of this invention is that it controls the capacity of a fixed speed compressor relative to the rate at which the supply gas is generated. A further advantage of this invention is that it is safer to operate and more convenient than prior compressors. Still another advantage of this invention is that the average operating efficiency of the gas generator over a period of time is increased because the back pressure at the outlet of the gas generator is maintained at substantially optimum operating conditions. A still further advantage of this invention is that continuous monitoring by a person is reduced if not eliminated. Yet another advantage of this invention is that the oil consumption of the compressor is improved because the existence of a vacuum at the inlet of the compressor is eliminated. A yet further advantage of this invention is that there is no discharge of the gas to an ambient when there is not sufficient gas at the inlet of the compressor.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. In combination:

a compressor operating at a fixed speed;

gas generating means producing a varying supply of gas; said compressor having its inlet communicating with said gas generating means to receive gas therefrom;

said compressor including means to compress the gas entering said inlet of said compressor;

said compressor having an outlet to discharge the compressed gas;

first connecting means to provide communication between said outlet of said compressor and said inlet of said compressor exterior of said compressor, said first connecting means providing the sole communication between said outlet of said compressor and said inlet of said compressor;

valve means in said first connecting means to block said first connecting means when said gas generating means is supplying sufficient gas to maintain the pressure of the gas at the inlet of said compressor above a predetermined pressure;

said first connecting means having causing means solely therein to cause movement of said valve means to a position in which said valve means does not block said first connecting means when the pressure at the inlet of said compressor drops below the predetermined pressure;

and said causing means including means responsive solely to the pressure of the gas supplied from said gas generating means to cause movement of said valve means to the position in which said valve means does not block said first connecting means.

2. The combination according to claim 1 in which said responsive means communicates solely with said first connecting means.

3. The combination according to claim 2 in which said responsive means of said causing means is connected to said valve means.

4. The combination according to claim 3 in which:

said compressor is a reciprocating two-stage compressor comprising a low pressure stage having an inlet and an outlet and a high pressure stage having an inlet and an outlet;

said low pressure stage having its inlet connected to said gas generating means;

second connecting means connecting said outlet of said low pressure stage to said inlet of said high pressure stage;

said high pressure stage having its outlet discharge the compressed gas from said compressor, said outlet of said high pressure stage having no communication with said outlet of said low pressure stage;

and said first connecting means connecting said outlet of said low pressure stage to said inlet of said low pressure stage.

5. The combination according to claim 3 in which:

said compressor is a reciprocating two-stage compressor comprising a low pressure stage having an inlet and an outlet and a high pressure stage having an inlet and an outlet;

said low pressure stage having its inlet connected to said gas generating means;

second connecting means connecting said outlet of said low pressure stage to said inlet of said high pressure stage;

said high pressure stage having its outlet discharge the compressed gas from said compressor;

and said first connecting means connecting said outlet of said high pressure stage to said inlet of said low pressure stage.

6. The combination according to claim 3 in which said responsive means of said causing means includes means acted on by the pressure of the gas supplied from said gas generating means to cause movement of said valve means to a position in which said valve means does not block said first connecting means when the pressure of the gas supplied from said gas generating means drops below the predetermined pressure.

7. The combination according to claim 1 in which said responsive means of said causing means is responsive to the pressure in said first connecting means downstream of said valve means.

8. The combination according to claim 1 including:

check valve means disposed in said first connecting means between said inlet of said compressor and said valve means in said first connecting means;

and said first connecting means communicating with said gas generating means between said check valve means and said valve means in said first connecting means.

9. The combination according to claim 1 including:

second connecting means to connect said gas generating means to said inlet of said compressor;

and check valve means disposed in said second connecting means between said gas generating means and the communication of said first connecting means with said inlet of said compressor.

10. A method of controlling a compressor operating at a fixed speed and having its inlet communicating with carbon dioxide generating means producing a varying supply of carbon dioxide from an ambient with which the carbon dioxide generating means communicates including:

connecting an outlet of the compressor with its inlet exterior of the compressor to provide the sole communication between the outlet of the compressor and the inlet of the compressor;

blocking the connection of the outlet of the compressor with its inlet when the carbon dioxide generating means is supplying sufficient carbon dioxide to maintain the pressure of the carbon dioxide at the inlet of the compressor above a predetermined pressure so that the compressed carbon dioxide is discharged from the ambient with which the carbon dioxide generating means communicates to a second ambient at a higher pressure than the ambient with which the carbon dioxide generating means communicates;

unblocking the connection of the outlet of the compressor with its inlet when the carbon dioxide generating means is not supplying sufficient carbon dioxide to maintain the pressure of the carbon dioxide at the inlet of the compressor above the predetermined pressure;

maintaining the connection of the outlet of the compressor with its inlet unblocked until the carbon dioxide generating means is supplying sufficient carbon dioxide to maintain the pressure of the carbon dioxide at the inlet of the compressor above the predetermined pressure;

and allowing communication from the outlet of the compressor to the second ambient only when the pressure at the outlet of the compressor is above the pressure in the second ambient.

11. The method according to claim 10 in which:

the compressor is a reciprocating two-stage compressor having a low pressure stage with an inlet and an outlet and a high pressure stage having an inlet connected to the outlet of the low pressure stage and an outlet;

the outlet of the low pressure stage is the outlet of the compressor connected to the inlet of the low pressure stage;

and the outlet of the high pressure stage has no communication with the outlet of the low pressure stage.

12. The method according to claim 10 in which:

the compressor is a reciprocating two-stage compressor having a low pressure stage with an inlet and an outlet and a high pressure stage having an inlet connected to the outlet of the low pressure stage and an outlet;

and the outlet of the high pressure stage is the outlet of the compressor connected to the inlet of the low pressure stage.

13. The combination according to claim 3 in which:

said compressor is a reciprocating compressor having a plurality of pressure stages, said compressor including a low pressure stage having an inlet and an outlet and at least one additional pressure stage having an inlet and an outlet;

said low pressure stage having its inlet connected to said gas generating means;

each of said plurality of pressure stages except said low pressure stage having its inlet connected to said outlet of the next lower pressure stage;

the highest of said plurality of pressure stages having its outlet discharge the compressed gas from said compressor, said outlet of the highest of said plurality of stages having no communication with the outlet of any of the other of said plurality of pressure stages;

and said first connecting means connecting said outlet of one of said plurality of pressure stages to said inlet of said low pressure stage.

14. The combination according to claim 13 in which said responsive means of said causing means includes means acted on by the pressure of the gas supplied from said gas generating means to cause movement of said valve means to a position in which said valve means does not block said first connecting means when the pressure of the gas supplied from said gas generating means drops below the predetermined pressure.

15. The combination according to claim 3 in which:

said compressor is a reciprocating compressor having at least one pressure stage, any of said pressure stages having an inlet and an outlet;

said one pressure stage having its inlet connected to said gas generating means;

any of said pressure stages except said one pressure stage having its inlet connected to said outlet of the next lower pressure stage;

the highest of said pressure stages having its outlet discharge the compressed gas from said compressor, said outlet of the highest of said pressure stages having no communication with said outlet of any other of said pressure stages;

and said first connecting means connecting said outlet of one of said pressure stages to said inlet of said one pressure stage.

16. The combination according to claim 15 in which said responsive means of said causing means includes means acted on by the pressure of the gas supplied from said gas generating means to cause movement of said valve means to a position in which said valve means does not block said first connecting means when the pressure of the gas supplied from said gas generating means drops below the predetermined pressure.

17. The combination according to claim 3 in which:

said compressor is a reciprocating two-stage compressor comprising a low pressure stage having an inlet and an outlet and a high pressure stage having an inlet and an outlet;

said low pressure stage having its inlet connected to said gas generating means;

second connecting means connecting said outlet of said low pressure stage to said inlet of said high pressure stage;

said high pressure stage having its outlet discharge the compressed gas from said compressor, said outlet of said high pressure stage having no communication with said outlet of said low pressure stage;

and said first connecting means connecting said outlet of one of said low pressure stage and said high pressure stage to said inlet of said low pressure stage.

18. The combination according to claim 17 in which said responsive means of said causing means includes means acted on by the pressure of the gas supplied from said gas generating means to cause movement of said valve means to a position in which said valve means does not block said first connecting means when the pressure of the gas supplied from said gas generating means drops below the predetermined pressure.

19. The combination according to claim 1 in which:

said compressor is a reciprocating compressor having a plurality of pressure stages, said compressor including a low pressure stage having an inlet and an outlet and at least one additional pressure stage having an inlet and an outlet;

said low pressure stage having its inlet connected to said gas generating means;

each of said plurality of pressure stages except said low pressure stage having its inlet connected to said outlet of the next lower pressure stage;

the highest of said plurality of pressure stages having its outlet discharge the compressed gas from said compressor, said outlet of the highest of said plurality of pressure stages having no communication with said outlet of any of the other of said plurality of pressure stages;

and said first connecting means connecting said outlet of one of said plurality of pressure stages to said inlet of said low pressure stage.

20. The combination according to claim 19 in which said responsive means of said causing means is responsive to the pressure in said first connecting means downstream of said valve means.

21. The method according to claim 10 in which:

the compressor is a reciprocating compressor having at least one pressure stage, any of the pressure stages having an inlet and outlet with any of the pressure stages except the one pressure stage having its inlet connected to the outlet of the next lower pressure stage;

the outlet of one of the pressure stages is the outlet of the compressor connected to the inlet of the one pressure stage;

and the outlet of the highest of the pressure stages has no communication with the outlet of any other pressure stage.

22. The combination according to claim 2 in which said responsive means of said causing means is subjected at all times to the pressure existing in said first connecting means between said valve means and said inlet of said compressor.

23. The combination according to claim 19 in which each of said plurality of pressure stages is a single cylinder.

24. The combination according to claim 1 in which:

said gas generating means comprises carbon dioxide generating means producing a varying supply of carbon dioxide from an ambient with which said carbon dioxide generating means communicates;

and said outlet of said compressor discharges carbon dioxide exterior of the ambient with which said carbon dioxide generating means communicates.

* * * * *

UNITED STATES PATENT AND TRADEMARK OFFICE

CERTIFICATE OF CORRECTION

PATENT NO. : 4,413,951

DATED : November 8, 1983

INVENTOR(S) : Clifford W. Allen Jr.

It is certified that error appears in the above—identified patent and that said Letters Patent is hereby corrected as shown below:

Column 1, line 18, "distance" should read -- discharge --.

Column 3, line 17, "gas" should read -- carbon dioxide --.

Column 4, line 35, "perssure" should read -- pressure --.

Column 4, line 46, before "which" insert a -- comma (,) --.

Column 4, line 58, after "50" insert -- is --.

Column 5, line 45, "is" should read -- in --.

Column 6, line 62, "connection" should read -- connections --.

Column 7, line 51, "said" begins a new paragraph.

Signed and Sealed this

Seventeenth Day of January 1984

[SEAL]

Attest:

GERALD J. MOSSINGHOFF

Attesting Officer

Commissioner of Patents and Trademarks